US010561196B2

(12) United States Patent
Schindler

(10) Patent No.: US 10,561,196 B2
(45) Date of Patent: Feb. 18, 2020

(54) SHOE WITH EXCHANGEABLE UPPER

(71) Applicant: Viviana Schindler, Boulder, CO (US)

(72) Inventor: Viviana Schindler, Boulder, CO (US)

( * ) Notice: Subject to any disclaimer, the term of this patent is extended or adjusted under 35 U.S.C. 154(b) by 199 days.

(21) Appl. No.: 15/375,511

(22) Filed: Dec. 12, 2016

(65) Prior Publication Data

US 2017/0086529 A1 Mar. 30, 2017

Related U.S. Application Data

(63) Continuation-in-part of application No. 14/012,700, filed on Aug. 28, 2013, now abandoned, which is a continuation-in-part of application No. 13/269,329, filed on Oct. 7, 2011, now abandoned.

(51) Int. Cl.

| | |
|---|---|
| ***A43B 3/24*** | (2006.01) |
| ***A43B 3/12*** | (2006.01) |
| ***A43B 3/00*** | (2006.01) |
| ***A43B 1/00*** | (2006.01) |

(52) U.S. Cl.

CPC ..... *A43B 3/244* (2013.01); *A43B 1/0027* (2013.01); *A43B 3/0078* (2013.01); *A43B 3/122* (2013.01); *A43B 3/242* (2013.01)

(58) Field of Classification Search

CPC ..... A43B 3/122; A43B 3/244; A43B 3/242; A43B 3/126; A43B 3/12; A43C 11/04; A43C 11/02; A43C 11/24; A43C 11/06

USPC ..... 24/575.1; 36/101, 7.5, 11.5, 100, 136

See application file for complete search history.

(56) References Cited

U.S. PATENT DOCUMENTS

| | | | | | |
|---|---|---|---|---|---|
| 900,881 | A * | 10/1908 | Parker | A43B 5/08 | 36/11.5 |
| 1,690,690 | A * | 11/1928 | Miller | A43C 11/14 | 36/45 |
| 1,721,819 | A * | 7/1929 | Hughes | A43C 5/00 | 24/713.7 |
| 1,880,845 | A * | 10/1932 | Czop | A44B 1/30 | 24/578.11 |
| 2,049,347 | A * | 7/1936 | Benjamin | A43B 1/0027 | 36/50.1 |
| 2,239,324 | A * | 4/1941 | Hills | A43C 5/00 | 24/713.7 |
| 2,469,708 | A * | 5/1949 | Alexander | A43B 3/122 | 24/713.6 |
| 2,526,940 | A * | 10/1950 | Joseph | A43B 3/122 | 36/11.5 |
| 2,551,723 | A * | 5/1951 | Camero | A43B 3/126 | 36/11.5 |
| 2,901,800 | A * | 9/1959 | Koehl | F16B 19/10 | 16/2.1 |
| 2,976,623 | A * | 3/1961 | Gallaway | A43B 3/122 | 36/100 |
| 3,010,169 | A * | 11/1961 | Carpinella | A44B 17/00 | 24/107 |

(Continued)

*Primary Examiner* — Katharine Gracz

(74) *Attorney, Agent, or Firm* — Macheledt Bales LLP; Jennifer L. Bales

(57) ABSTRACT

An article of footwear comprising a sole constructed for receiving a foot having a toe section and an ankle section with at least two loops fixedly attached to the toe section; an interchangeable upper, or several interchangeable uppers, having loops for securing the upper to the loops of the sole of the footwear; such uppers and soles attached by specialized clips adapted to facilitate a wide variety of advantages.

15 Claims, 8 Drawing Sheets

(56) References Cited

U.S. PATENT DOCUMENTS 3,037,542 A * 6/1962 Boyd ..... F16B 5/0208 411/105
3,698,107 A * 10/1972 Fukuoka ..... A43B 3/10 36/11.5
3,732,638 A * 5/1973 Hanley ..... D05C 1/02 38/102.91
3,925,915 A * 12/1975 Colli ..... A43B 3/103 36/101
4,450,633 A * 5/1984 Connelly ..... A43B 1/0054 36/101
4,461,102 A * 7/1984 DeVincentis ..... A43B 3/122 24/265 H
4,479,289 A * 10/1984 Rutgersson ..... A44B 13/0082 24/687
5,651,195 A * 7/1997 Clancy ..... A43B 3/12 36/11.5
5,852,885 A * 12/1998 Ferniani ..... A43B 3/103 36/11.5
5,896,684 A * 4/1999 Lin ..... A43B 3/103 36/101
5,992,058 A * 11/1999 Jneid ..... A43B 3/122 36/100
D419,283 S * 1/2000 Coito ..... D2/916
6,295,743 B1 * 10/2001 Brooks ..... A43B 7/20 36/105
6,640,464 B2 * 11/2003 Hsin ..... A43B 3/122 36/101
6,848,199 B1 * 2/2005 Giannelli ..... A43B 13/36 36/101
6,904,706 B2 * 6/2005 Jones ..... A43B 1/0027 36/101
7,028,420 B2 * 4/2006 Tonkel ..... A43B 3/102 36/100
7,168,189 B2 * 1/2007 Phelan ..... A43B 3/122 36/101
D561,455 S * 2/2008 Belley ..... D2/917
7,681,331 B2 * 3/2010 Bathum ..... A43B 3/108 36/11.5
8,020,319 B1 * 9/2011 Mohaupt ..... A43B 3/122 36/101
8,661,715 B2 * 3/2014 Roth ..... A43B 3/244 36/100
9,155,350 B2 * 10/2015 Chapin ..... A43B 3/0078
2005/0262738 A1 * 12/2005 Gerber ..... A43B 3/103 36/101
2006/0026861 A1 * 2/2006 Manzi ..... A43B 3/122 36/11.5
2006/0059720 A1 * 3/2006 Phelan ..... A43B 3/122 36/101
2009/0038181 A1 * 2/2009 Loughnane ..... A43B 3/103 36/94
2009/0193684 A1 * 8/2009 Diamond ..... A43B 1/0081 36/101
2009/0293312 A1 * 12/2009 Scozzafava ..... A43B 3/122 36/101
2010/0184349 A1 * 7/2010 Hernandez ..... A43B 3/0078 446/71
2010/0223812 A1 * 9/2010 Batanero Bastida .. A43B 3/103 36/100
2011/0283564 A1 * 11/2011 Stillwagon ..... A43B 3/103 36/101
2014/0259295 A1 * 9/2014 Guglielmo ..... A43B 23/24 2/245

* cited by examiner

SHOE WITH EXCHANGEABLE UPPER

CROSS REFERENCE TO RELATED APPLICATIONS

This application is a continuation-in-part of application Ser. No. 14/012,700, filed 28 Aug. 2013, which is a continuation-in-part of application Ser. No. 13/269,329, filed 7 Oct. 2011.

BACKGROUND OF THE INVENTION

Field of the Invention

The field to which this invention pertains is shoes with exchangeable uppers, which are typically women's shoes.

Description of Related Art

For the most part, shoes comprise a sole to protect the foot from the ground; and uppers, or vamps; to secure the foot to the sole. Shoes are ubiquitous, and a high value is often placed upon appearance. In general, the advantage of shoes with exchangeable uppers is that the appearance of the shoe can be adapted to best coordinate with the rest of one's outfit: mixing and matching fabrics, colors, and styles into aesthetically pleasing combinations. Additionally, the number of sole to upper combinations makes the transport and storage of a wider variety of footwear options easier.

Shoes with removable uppers are not novel to the apparel industry. For example, U.S. Pat. No. 7,810,253 (Barteet) and U.S. Pat. App. Pub. No. US2011/0056091 (Shmurack et al.) describe detachable shoe upper systems currently on the market. Barteet describes a system to affix the sole of the shoe to the uppers using snap fasteners, while Shmurack et al. describes a system to affix the sole of a shoe to the uppers using posts and loops. The disadvantages of both Barteet and Shmurack et al systems are both aesthetic; as the snap, post, and loop fasteners are visible and detract from the aesthetics of the shoe; and functional, as the protruding snaps, posts, and loops can catch on external objects causing the shoe to come apart and risk possible injury to the foot. Both problems may be solved with a shoe whose fastener is aesthetically pleasing, durable, and secure.

SUMMARY OF THE INVENTION

None of the particular objects or advantages that follow must be entirely satisfied as they are non-exclusive alternatives and at least one of the following objects is met; accordingly, several objects and advantages of the present invention are:

(a) to provide a means for attaching the sole of a shoe to an upper;

(b) to provide a means for attaching the sole of a shoe to an upper that is aesthetically pleasing;

(c) to provide a means for attaching the sole of a shoe to an upper that is durable;

(d) to provide a means for attaching the sole of a shoe to an upper that allows the upper to be quickly and conveniently attached and detached;

(e) to provide a means for attaching the sole of a shoe to an upper that is unlikely to accidentally catch on another object;

(f) to provide a means for attaching the sole of a shoe to an upper that is itself capable of being used interchangeably between many shoe soles and uppers;

(g) to provide a means for attaching the sole of a shoe to an upper that is capable of opening and closing;

(h) to provide a means for attaching the sole of a shoe to an upper that is capable of remaining open or closed in a secured manner;

(i) to provide a means for attaching the sole of a shoe to an upper that is cheaply and easily produced;

(j) to provide a means for attaching the sole of a shoe to an upper that is itself capable of tightening or loosening the shoe upper to a sole;

(k) these and other objectives and advantages of the instant invention will become apparent from the following description taken in conjunction with the accompanying drawings wherein are set forth, by way of illustration and example, certain embodiments of the instant invention. The drawings constitute a part of this specification and include exemplary embodiments of the present invention and illustrate various objects and features thereof.

DETAILED DESCRIPTION OF THE INVENTION

Figure 1:
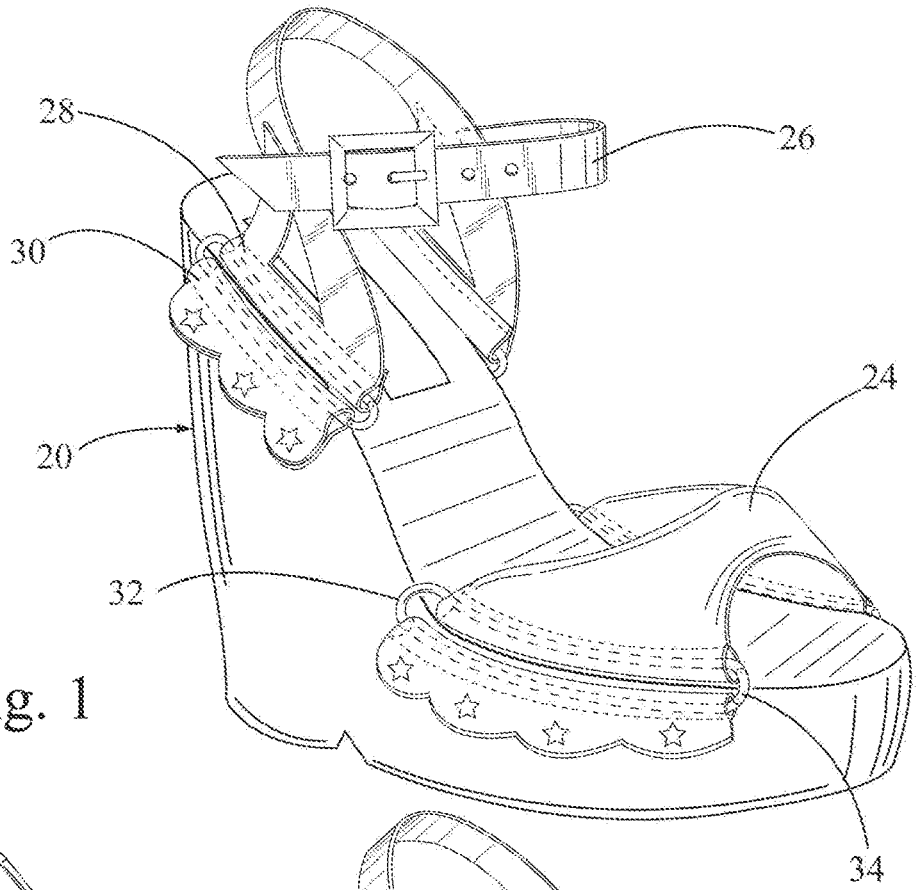
FIG. 1 illustrates an isometric perspective view of footwear with an exchangeable upper that is attached to a sole.

For the purposes of promoting an understanding of the principles of the invention, reference will now be made to the embodiments illustrated in the drawings and specific language will be used to describe the same. However, the illustrated embodiments are merely exemplary and many additional embodiments of this invention are possible. For example, a wedge shoe is pictured; however, this invention can be applied to most footwear. It is understood that no limitation of the scope of the invention is thereby intended. Any alterations and further modifications in the illustrated devices, and such further application of the principles of the invention as illustrated herein are contemplated as would normally occur to one skilled in the art to which the invention relates.

Unless otherwise indicated, the drawings are intended to be read (e.g., arrangement of parts, proportion, degree, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "rightwardly", "upwardly", etc.), simply refer to the orientation of the illustrated structure as the particular drawing figure faces the reader. Similarly, the terms "inwardly" and "outwardly" generally refer to the orientation of a surface relative to its axis of elongation, or axis of rotation, as appropriate.

1. The Shoe

Figure 2:
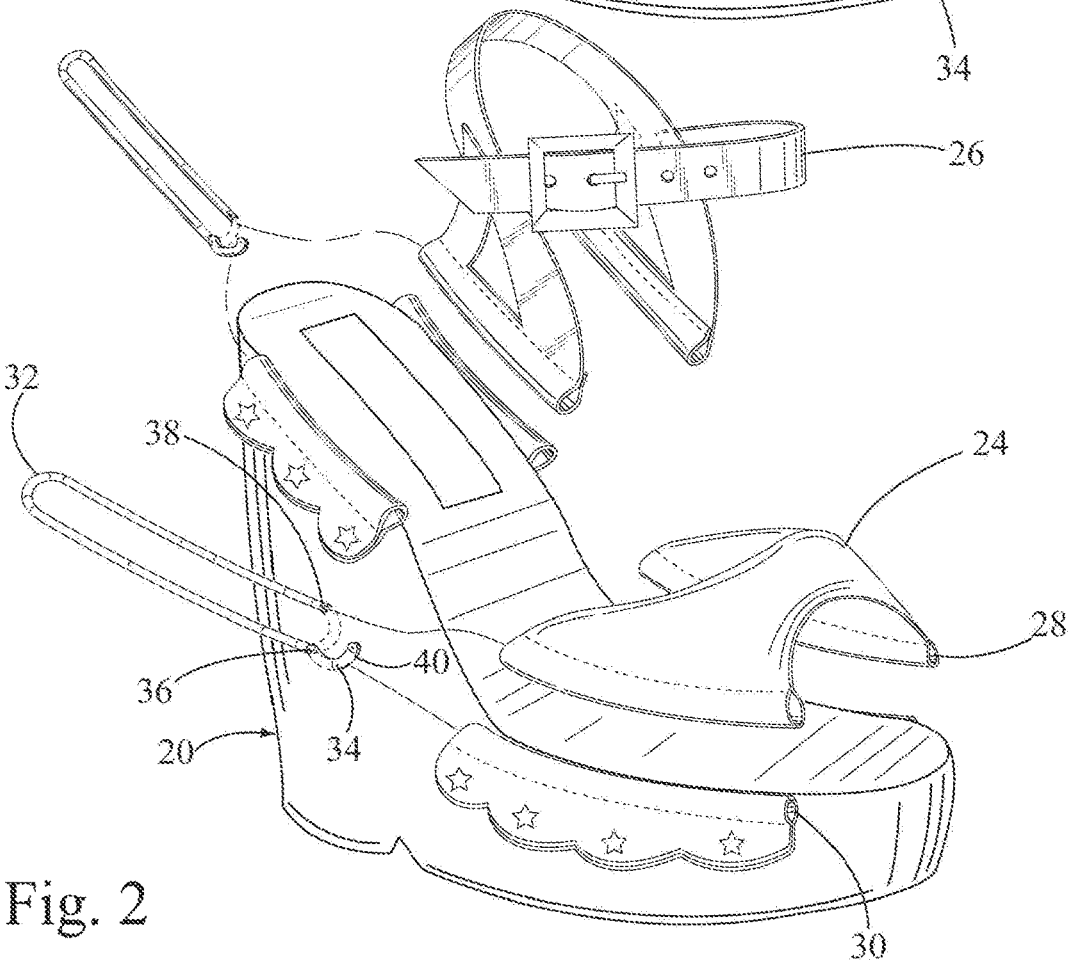
FIG. 2 illustrates an isometric perspective view of footwear with an exchangeable upper that is detached from a sole.

Shown throughout the figures, the instant invention is generally directed toward attaching a sole of a piece of footwear to an upper. An embodiment of such system of attaching the sole of a piece of footwear to an upper is illustrated in FIG. 1, said upper is illustrated as unattached in FIG. 2. The sole (20) of the footwear can be of any design used for the soles of footwear, including: wedges, heels, flats, etc. and is not limited to any specific design of a sole. [0009] Attached to said sole of the footwear are loops (30) adapted to receive a clip, clasp, hook, carabiner; or other means of removable attachment (32). Additionally, the footwear comprises either one, or multiple, uppers, such as: an upper that secures the toe section (24); an upper that secures the ankle section (26); or any upper that may attach anywhere to a sole (20), thereby securing the foot to said sole (20). This invention contemplates uppers that have loops (28) adapted to receive a clip, clasp, hook, carabiner; or other means of removable attachment (32). The loops of both the sole (30) and of the uppers (28) can be made of any material so long as they are sturdy enough to withstand the wear and tear customary to footwear.

The third component of the footwear is a clip, clasp, hook, carabiner; or other means of removable attachment (32). Such clip can be made of any durable material suitable to its purpose. The loops on the sole (30) and the loops on the uppers (28) are then connected with the clip, clasp, hook, carabiner; or other means of removable attachment (32) creating the complete shoe. In the embodiment shown in FIG. 1 and FIG. 2, the clip is shown with a hinge (36) that allows an arm (34) to pivot outwardly when its opposite end containing a retention pin (40) is released from a socket (38) for fitting the opposing pin (40).

In general, the advantage of shoes with exchangeable uppers is that the appearance of the shoe can be adapted to best coordinate with the rest of one's outfit; mixing and matching fabrics, colors, and styles into aesthetically pleasing combinations.

Additionally, the number of sole to upper combinations makes the transport and storage of a wider variety of footwear options easier. It is contemplated that the uppers, soles, and means of attachment of the two can be selected to coordinate with the wearer's wardrobe and can be made out of any suitable material.

2. The Clip, Clasp, Hook, Carabiner; or Other Means of Removable Attachment of the Sole and Upper of the Footwear This invention presents several improvements over the prior art in the clip, clasp, hook, carabiner; or other means of removable attachment of the sole of the footwear to the upper. FIGS. 3 through 17 illustrate various improvements in the means for removable attachment of the sole of a piece of footwear to an upper.

Figure 3:
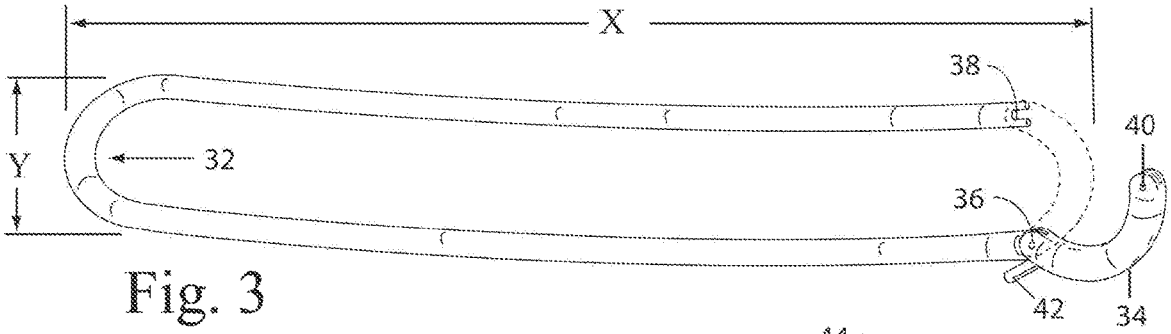
FIG. 3 illustrates a clip with a snap closure.
Figure 4:
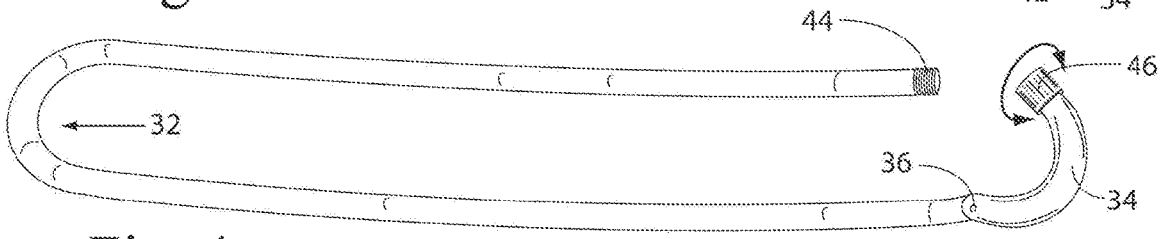
FIG. 4 illustrates a clip with an oppositely threaded closure.

FIG. 3 illustrates a preferred embodiment of a clip (32) with horizontal length x adapted to suit the length of the loops on the uppers and soles of the footwear and a vertical length y adapted to suit the thickness of said loops. The vertical length y also determines the desired gap between said upper and sole loops within the clip. In this embodiment, the clip arm (34) opens outward and remains attached to the clip by a hinge (36). The arm of the clip (34) is located on the outward end of the clip which allows for opening of the arm (34) when the majority of the clip (32) is covered by the upper and sole loops of the footwear. This positioning of the arm of the clip (34) also allows the arm, and thereby the entire clip, to be easy extracted through said loops. This clip (32) can be locked into a closed position by pressing inwardly on the hinged arm (34), which contains a retaining pin (40) that snaps into a containing socket (38). The arm of the clip (34) can then be opened again by pushing or pulling outwardly on the arm of the clip (34). Additionally, the arm (34) may be opened by pressing against an optional lever (42) adapted for applying a torque on the hinge (36), thereby opening the clip. Such optional lever (42) being capable of sliding into a slot in the clip when the arm (34) is open, thereby facilitating easy removal of the clip from the loops of the uppers and soles of the footwear without said optional lever (42) impeding the removal of the clip. FIG. 4 is very similar to FIG. 3, with the exception that the means for locking the clip closed is comprised of oppositely oriented threaded regions on the clip (44) and arm (46) that screw together in a carabiner type fashion.

Figure 5:
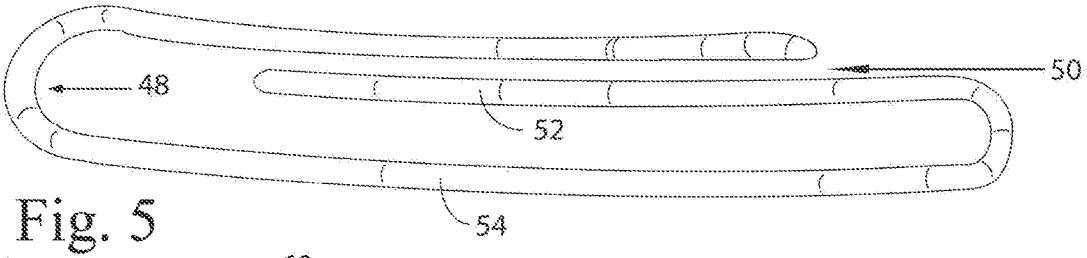
FIG. 5 illustrates a clip with overlapping design.

FIG. 5 illustrates another embodiment of a clip (48). This embodiment is similar to a paper clip in that the loops of the uppers and sole of the footwear are threaded through an open recess in the clip (50) into an inner chamber within the clip defined by an upper portion of the clip (52) and a bottom portion of the clip (54). The paper clip type nature of the clip encircling itself then prevents the loops from unintentionally leaving the inner chamber of the clip. This design can be circular, or any other self-enclosing shape. The further the loops of the upper or lower are pushed into the spirals of the clip, the smaller the gap between the upper and sole loops become, thereby tightening the shoe to the foot.

Figure 6A:
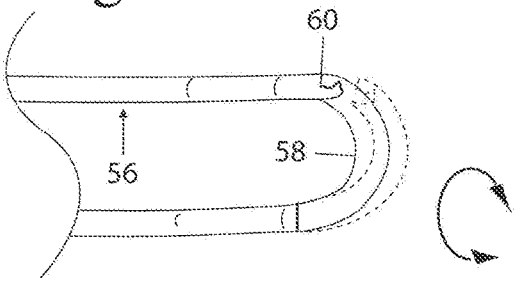
FIG. 6A illustrates a clip that screws open with a snap closure in the closed position.
Figure 6B:
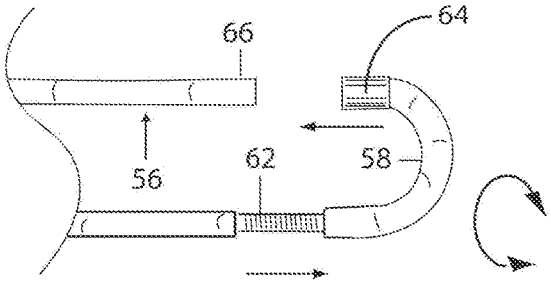
FIG. 6B illustrates a clip that screws open with a slide closure in the open position.

FIG. 6A and FIG. 6B illustrate another embodiment of a clip (56) that is similar to FIG. 3, except that instead of having an arm (34) on a hinge (36), this embodiment has an arm (58) that rotates perpendicularly to the horizontal axis of the clip. Such arm (58) is shown with a snap closure (60), although it can be outfitted with a variety of closures; such as, but not limited to the closure illustrated in FIG. 4. FIG. 6B shows the same clip (56) as FIG. 6A, except that it is in the open position. This open position exposes the threads on the shaft of the arm (62) that screw into the oppositely oriented threads within the open shaft of the clip. FIG. 6B also shows an alternate locking mechanism comprising a hollow spring-loaded cylinder (64) that you can pull back as you screw the arm (58) toward the clip (56) and release to attach to the opposing end of the clip (66), thereby preventing the arm (58) from opening by rotating perpendicularly to the horizontal axis of the clip (56). The clip shown in FIG. 6A and FIG. 6B allows the loops of the uppers to be quickly released from the sole of the footwear while the loops of the sole can only be easily released by completely unscrewing the arm of the clip (58).

Figure 7A:
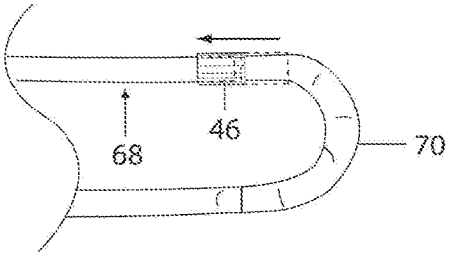
FIG. 7A illustrates a clip that slides open with an oppositely threaded closure in the closed position.
Figure 7B:
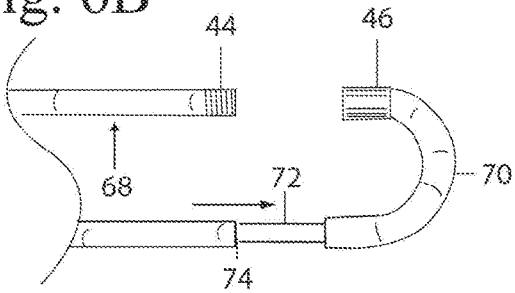
FIG. 7B illustrates a clip that slides open with an oppositely threaded closure in the open position.

FIG. 7A and FIG. 7B illustrate another embodiment of a clip (68) that is similar to FIG. 3, except that instead of having an arm (34) on a hinge (36), this embodiment has an arm (70) with a smooth post (72) that slides into an aperture (74) in the clip (68). In FIG. 7A, the clip (68) is shown with a means for locking the clip (46) in the closed position. In FIG. 7B the means for closure is shown as comprised of oppositely oriented threaded regions on the clip (44) and arm (46); as in FIG. 4, that screw together in a carabiner type fashion; although the clip (68) can be outfitted with a variety of closures.

Figure 8:
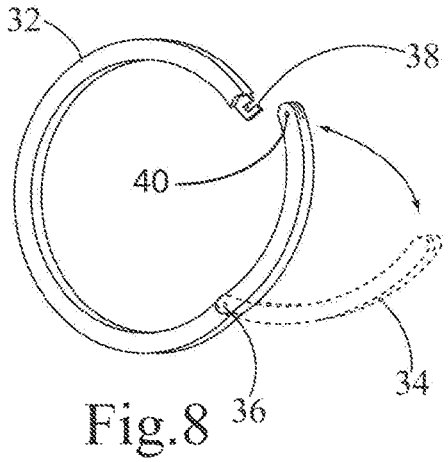
FIG. 8 illustrates a circular clip with a snap closure.
Figure 9:
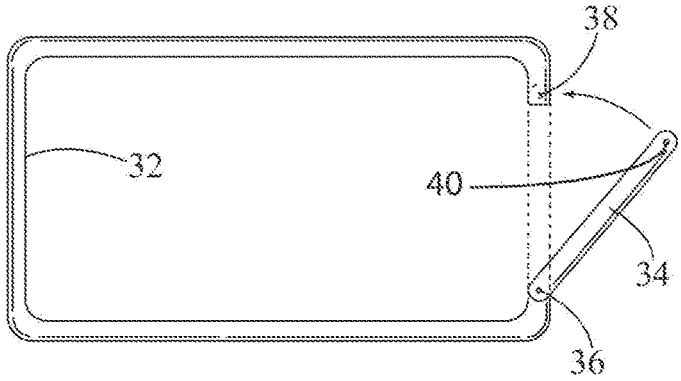
FIG. 9 illustrates a rectangular clip with a snap closure.
Figure 10:
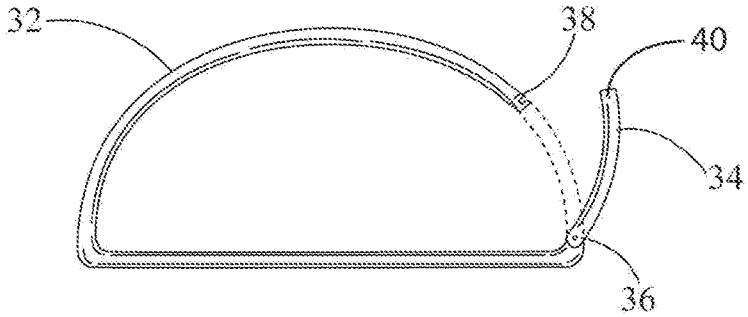
FIG. 10 illustrates a semi-circular clip with a snap closure.

FIG. 8, FIG. 9, and FIG. 10 illustrate a circular design, a rectangular design, and a semi circle design respectively of the same clip shown in FIG. 3. It is contemplated that having a variety of possible shapes is desirable to facilitate the maximum number of possible combinations and styles achievable when mixing and matching the soles of the footwear with the clips and uppers of the footwear. It is also contemplated that the loops of the soles and uppers of the footwear may be curved and that having a curvature in the clip for attaching those loops might be desirable. While FIG. 8, FIG. 9, and FIG. 10 illustrate alternate embodiments of the clip (32) shown in FIG. 3, such alternate shapes can be applied to any of the clips described in the specification and those which would be apparent to those skilled in the art that may be derived from the clips described in the specification.

Figure 11A:
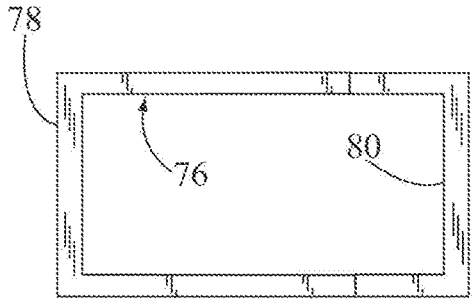
FIG. 11A illustrates a clip with internal prong closures in the closed position.
Figure 11B:
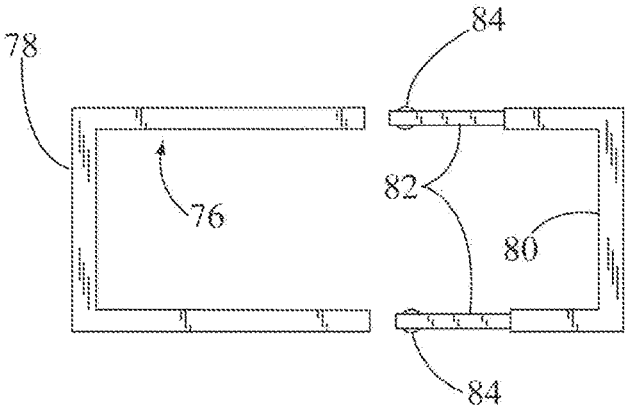
FIG. 11B illustrates a clip with internal prong closures in the open position.

FIG. 11A illustrates a closed, and FIG. 11B illustrates an open, configuration of the same embodiment of a clip (76). This embodiment of the clip (76) comprises two two-prong arms, with one two-prong arm (80) being adapted with posts (82) that slide into the other two-prong arm (78). When the two two-prong arms are joined they are fastened by a locking mechanism (84) on the posts (82) of the arm (80) that is inserted into the opposing arm (78), thereby concealing such locking mechanism. Such locking mechanism can be oppositely oriented ridges on the posts (84) and within the opposing arm that hold the clip (76) closed with pressure and friction, or any other locking mechanism well-adapted to secure the two arms together. It is contemplated that this embodiment of the clip can be made with more than two prongs on each arm that slide into each other. An advantage of this embodiment of the clip is that there can be no moving parts to wear down and become a point of weakness on the two two-prong arms. This embodiment of the clip can also be cast and manufactured cheaply as there can be no moving parts which would need to be assembled. Additionally, this embodiment of the clip can be opened and closed quickly because the opening and closing of the clip (76) is accomplished by pulling both sides of the clip apart or pushing both sides of the clip together simultaneously with enough force to engage the fastening mechanism, thus little time would be needed to know if the clip was properly secured in the closed position.

Figure 12:
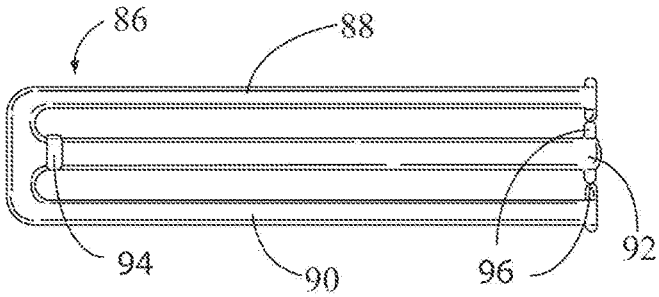
FIG. 12 illustrates a three prong clip with snap closures.

FIG. 12 illustrates an embodiment of a three prong clip (86). In this embodiment the three prong clip (86) has an upper (88) and lower (90) prong adapted to slide through the loops on the upper and sole of the footwear respectively. The middle prong of the clip (92) is attached between the other two prongs by means of a hinge (94) that allows the middle prong (92) to swing forward when the clip is inserted through the loops of the upper and sole of the footwear, and to swing back, locking the clip in place between the loops of the upper and sole of the footwear. The locking mechanism can be any mechanism capable of securing the middle prong (92) to the upper (88) and lower prongs (90). As it is shown, the locking mechanism are snaps (96) located between the upper (88), lower (90), and middle (92) prongs.

Figure 13:
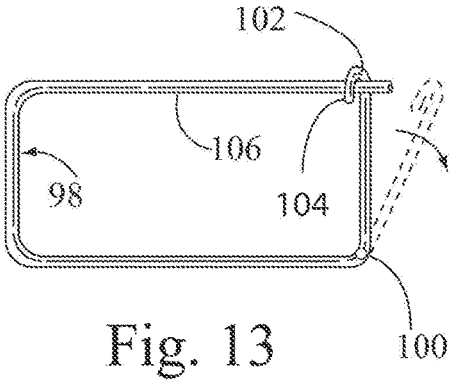
FIG. 13 illustrates a hinge and hook clip.

FIG. 13 illustrates a hinge and hook clip (98) similar to the clip (32) shown in FIG. 3 except that it comprises an arm (102) connected to a hinge (100) that is attached to the upper end of the clip (106) by a hook (104). The arm of the clip (102) disengages from the upper end of the clip (106) by snapping outward over the end of the upper end of the clip (106). This embodiment of the clip (98), is capable of being manufactured cheaply without the complexities of the fastening means illustrated in the other embodiments of the clips shown and may have aesthetic appeal to some customers.

Figure 14:
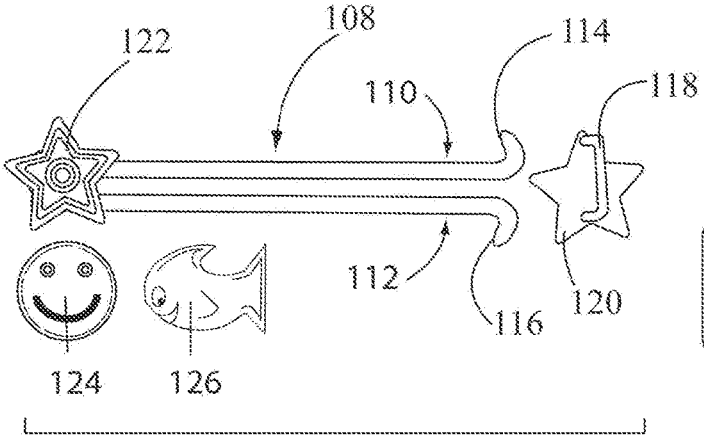
FIG. 14 illustrates a two prong clip with two hooks and a decorative closure.

FIG. 14 illustrates a two-prong clip with decorative closures (108). This embodiment of the clip has an upper prong (110) and a lower prong (112) with outwardly facing hooks on the upper (114) and lower (116) prongs. When the prongs are squeezed together they can be inserted into a loop (118) that retains the outwardly facing hooks on the upper (114) and lower (116) prongs, holding the loops of the upper and sole of the footwear in place by an outward tension created by the two prong clip (108). The face of the loop is illustrated as a decorative unit (120). This decorative unit can be mirrored symmetrically on the other side of the clip (108) with another similar fixed decorative unit (122). Embodiments of alternate faces for the decorative units are shown as a smiley face (124) and a fish (126) but may be of any design. This embodiment of the clip (108) has the advantage of not having any hinges to assemble as well as having an appeal to a consumer with a preference for a more decorative clip.

Figure 15:
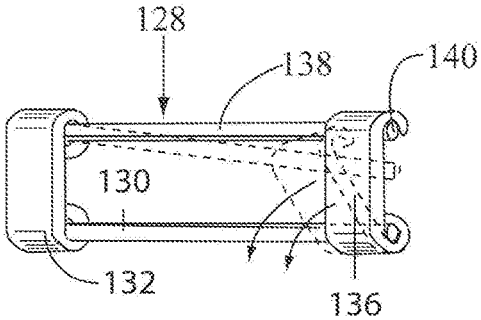
FIG. 15 illustrates a two prong clip with a hook closure.

FIG. 15 illustrates another embodiment of a two prong clip (128) that is fixedly attached to the loop on the sole of the footwear by the bottom prong (130), a side portion (132)

fixedly attaching the upper (132) and bottom prongs (134), and another side portion (136) capable of releasably securing the upper prong (138). The upper prong (138) can be disengaged from a hook (140) or other means for closure by either pressing down on the upper prong (138) or by pressing outward on the side portion capable of releasably securing the upper prong (136), or other means for closure. This embodiment may also be outfitted with a hinge allowing the bottom portion of the side portion capable of releasably securing the upper prong (136) for opening the closure with greater ease. An advantage of this embodiment of the clip (128) is that it remains attached to the loop on the sole of the footwear.

Figure 16:
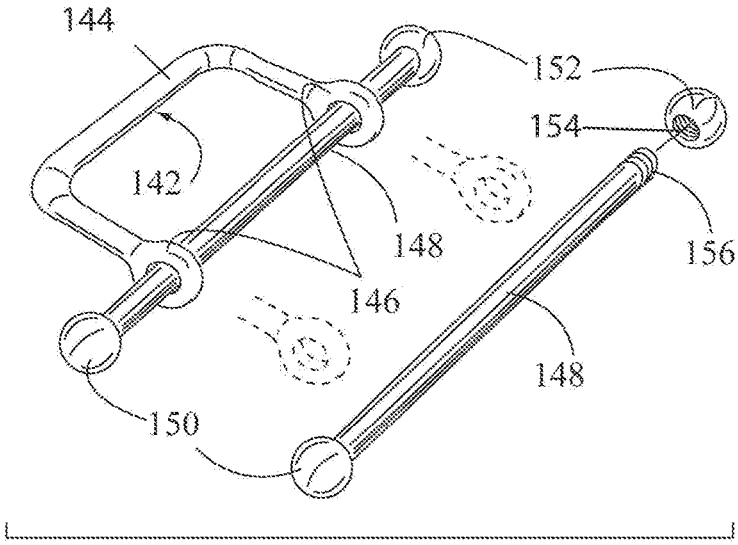
FIG. 16 illustrates a clip with a bar closure.

FIG. 16 illustrates an embodiment of a clip with a bar closure (142). In this embodiment of the clip there is a bar that creates an enclosure (144) with loops on either end of the bar (146) that can be inserted through a loop on the uppers or soles of footwear. When the bar that creates an enclosure (144) has been inserted through a loop on the upper or sole of a piece of footwear, another bar that inserts through the loops on the bar that creates the enclosure (148) can then be inserted through one of the loops (146) on either side of the bar that creates an enclosure (144), through a loop on the upper or sole of the footwear, then through the other loop on the bar that creates an enclosure (144); thereby attaching the sole of the footwear to the upper. The bar that inserts through the loops on the bar that creates the enclosure (148) is fixed in place by a retaining knob or other outwardly protruding structure on either side of the bar. As shown in the illustration, the bar that inserts through the loops on the bar that creates the enclosure (148) has a fixed knob on the left-hand side (150) and another knob on the right-hand side of the bar (152) that can be securely attached and detached from the bar that inserts through the loops on the bar that creates the enclosure (148) by use of oppositely threaded regions in the knob (154) and on the bar (156). Any other means known to those skilled in the art for attaching outwardly protruding structures on either side of the bar that inserts through the loops on the bar that creates the enclosure (148) are contemplated. An advantage of this embodiment of the clip (142) is that force acting on the vertical axis of the clip acts directly on the bar that inserts through the loops on the bar that creates the enclosure (148), and does not act on a hinge or other means for closing the clip; thus greatly increasing the strength of the clip.

Figure 17:
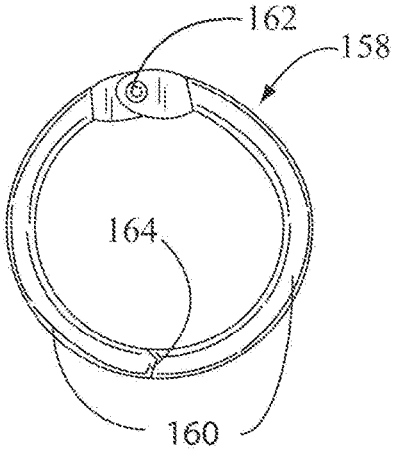
FIG. 17 illustrates a circular clip with hinge and snap closure.

FIG. 17 illustrates a circular clip with a hinge and snap closure (158). In this embodiment of a clip (158) two symmetrical half circle arms (160) are attached by a hinge (162) and snap together on their opposing ends (164). Both symmetrical sides (160) of the clip (158) are inserted through a loop on either an upper or the sole of the footwear thereby attaching the upper and sole of the footwear. Some advantages of this embodiment of the clip (158) are that it can be cheaply produced and easily operated. It is contemplated that this embodiment of the clip (158) might be ideal for use in children's shoes.

Figure 18:
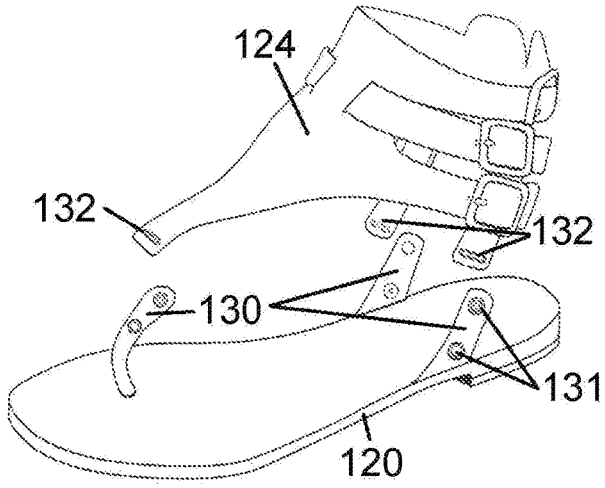
FIG. 18 is a side isometric drawing illustrating an eighteenth embodiment of the present invention, incorporating a loop and ring connection system in a detached configuration.
Figure 19:
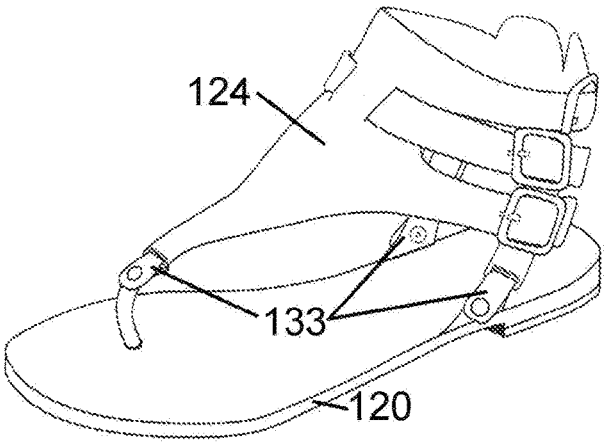
FIG. 19 is a side isometric drawing illustrating the embodiment of FIG. 18, in an attached configuration.
Figure 20:
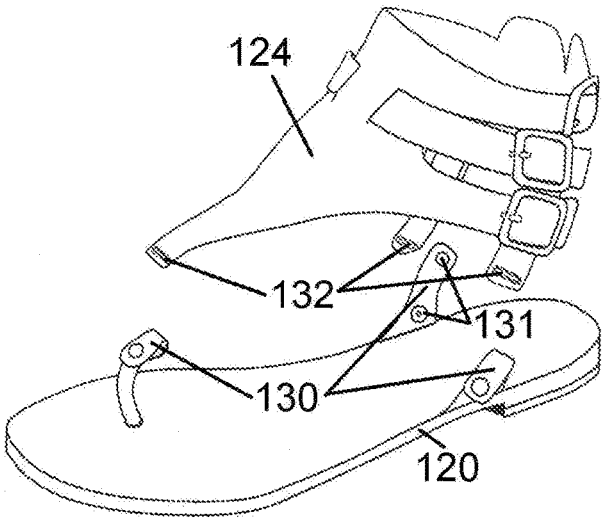
FIG. 20 is a side isometric drawing illustrating the embodiment of FIG. 18, in a detached configuration with some of the loop attachments closed to form loops.

FIGS. 18, 19 and 20 illustrate an eighteenth embodiment of the present invention, wherein upper 124 is attached to sole 120 via a loop and ring arrangement 133. FIG. 18 illustrates this embodiment in a detached configuration, FIG. 19 illustrates this embodiment in an attached configuration, and FIG. 20 illustrates this embodiment in a detached configuration with two of looping attachments 130 closed to form loops and one in an open, un-looped state. Each loop and ring arrangement 133 comprises looping attachment 130 and ring 132. In this embodiment, looping attachments 130 are formed of flexible leather, fabric or the like and include apparatus to attach the end of looping attachment 130 to itself, forming a loop to connect it to ring 132. For example, looping attachment 130 might comprise a snap fastener 131 wherein the male half of the snap passes through ring 132 and attaches to the female half to form a loop capturing ring 132 (or vice versa). In this embodiment, rings 132 are embedded within the material forming upper 124.

Figure 21:
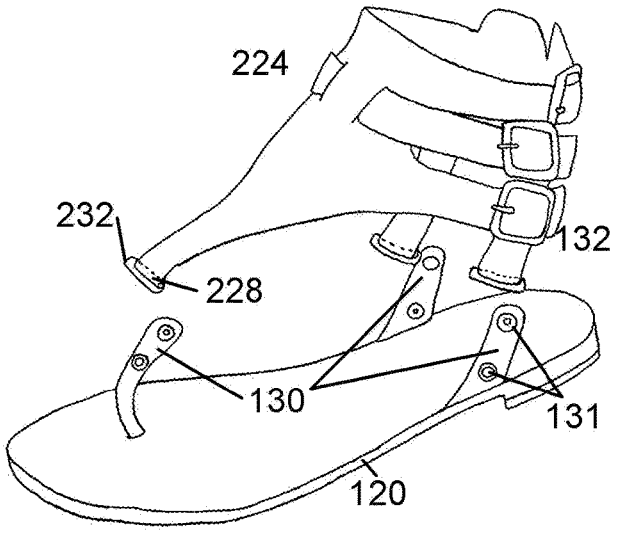
FIG. 21 is a side isometric drawing illustrating a nineteenth embodiment of the present invention, incorporating a variation on the loop and ring connection system of FIGS. 18-20, in a detached configuration.
Figure 22:
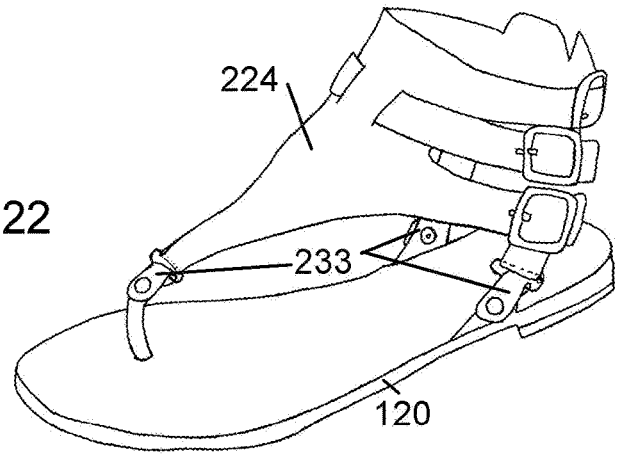
FIG. 22 is a side isometric drawing illustrating the embodiment of FIG. 21, in an attached configuration.
Figure 23A:
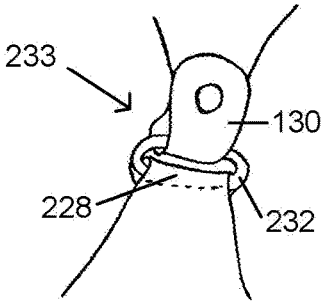
FIG. 23A is a detailed side isometric drawing illustrating the loop and ring connection system of FIGS. 21 and 22 in an attached configuration.
Figure 23B:
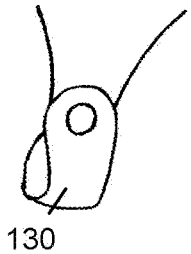
FIG. 23B is a detailed side isometric drawing illustrating the loop of FIGS. 21 and 22 in a closed configuration apart from the ring.
Figure 23C:
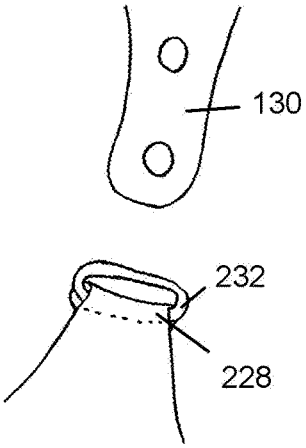
FIG. 23C is a detailed side isometric drawing illustrating the loop and ring connection system of FIGS. 21 and 22 in a detached configuration.

FIGS. 21, 22, and 23A-C illustrate a nineteenth embodiment of the present invention. FIG. 21 shows a detached configuration, FIG. 22 shows an attached configuration, and FIGS. 23A-C are detailed side isometric drawings illustrating the loop and ring connection system of FIGS. 21 and 22. FIG. 23A shows the loop and ring arrangement 233 in an attached configuration, FIG. 23B shows looping attachment 130 closed, but not attached to ring 232, and FIG. 23C shows loop and ring arrangement 233 in a detached configuration. This embodiment is very similar to the eighteenth embodiment illustrated in FIGS. 18-20. However, in this embodiment, ring 232 is attached to upper 224 rather than being embedded in it. In this particular embodiment, an extension of the material of upper forms a channel 228 within which ring 232 is threaded. For example, a portion of material may pass through ring 232 and be sewn to itself to form channel 228. Again, looping attachment 130 includes a self connection mechanism such as a snap 131.

Variations on the embodiments of FIGS. 18-23 fall within the spirit of the present invention. For example, looping attachments 130 might be attached to sole 120, and rings 132, 232 might be attached to uppers 124, 224. A different form of self-attachment besides a snap fastener might be used for looping attachment 130. Ring 232 might be attached by a different means than sewn channel 228.

Figure 24:
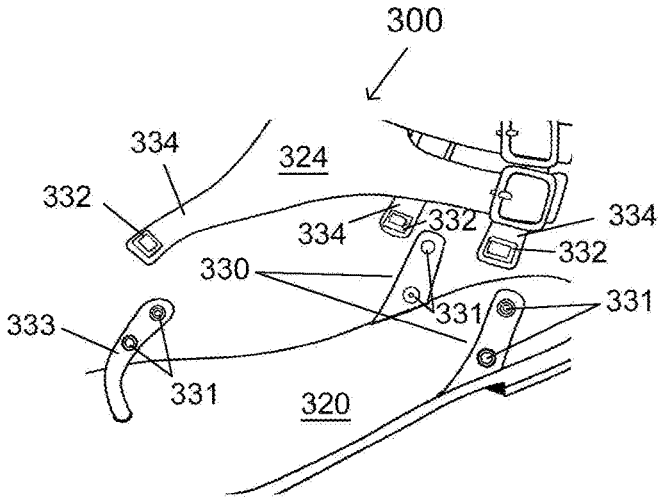
FIG. 24 is a side isometric drawing illustrating a twentieth embodiment of the present invention, incorporating a reinforced ring and a compression snap closure in a detached configuration
Figure 25:
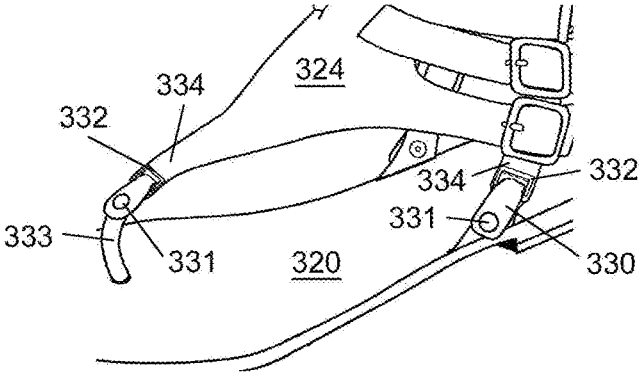
FIG. 25 is a side isometric drawing showing the embodiment of FIG. 24 in an attached configuration.

FIGS. 24-29 illustrate an embodiment of the present invention that is particularly useful for street sandals, where the wearer walks and runs in the sandals all day without lower looping straps 330, 333 coming open or grommets 332 tearing upper straps 334. FIG. 24 is a side isometric drawing of this embodiment incorporating a reinforced ring and a compression snap closure in a detached configuration. FIG. 25 is a side isometric drawing showing the embodiment of FIG. 24 in an attached configuration.

Figure 26:
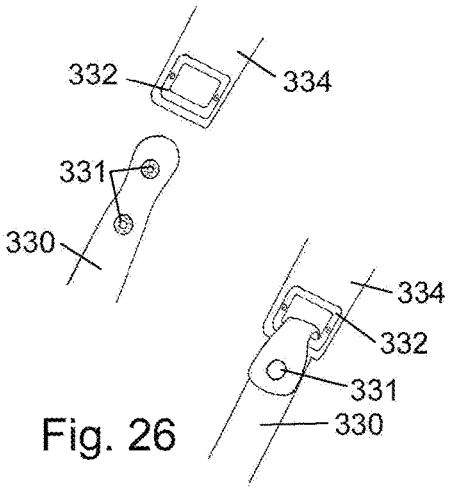
FIG. 26 is a detailed view of the reinforced ring and compression snap closure of FIGS. 24 and 25.
Figure 27:
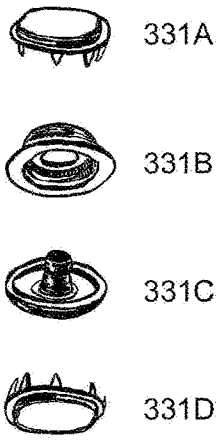
FIG. 27 is an exploded isometric view of a compression snap closure according to the present invention.

FIG. 26 is a detailed view of the reinforced ring and compression snap closure of FIGS. 24 and 25. FIG. 27 is an exploded isometric view of a compression snap closure 331 according to the present invention FIG. 24 shows a sole 320 with two attached looping straps 330 on either side of the ankle and a third attached looping strap 333 disposed between the wearer's toes. Straps 330, 333 are preferably a tough material such as leather. Each looping strap 330, 333 includes a compression snap closure 331. Compression snap closures 331 are particularly adapted to this street sandal, because once the stud 331C is inserted into the socket 331B and the sandal is donned, nearly all of the pressure on snap 331 is perpendicular to the axis of stud 331C, meaning that snap 331 is not urged open when the sandal is worn. However, since stud 331C is pressure fitted into socket 331B, it is easy for the wearer to open snap 331 by pulling the end of strap 330 or 333 thereby applying pressure parallel to stud 331C.

When sandal 300 is donned, the end of lower strap 330 is inserted into the opening of reinforced ring 332, embedded within upper strap 334 on upper 324. Then the male and female halves of snap 331 are snapped together, trapping grommet 332 within the loop formed in lower strap 330. Front lower strap 333 is attached similarly. Once all three snaps 331 are snapped into place, the sandal is assembled and ready to wear.

FIG. 27 shows an example of a compression snap fastener 331 according to the present invention. It comprises a socket cap 331A, a socket 331B, a stud 331C and a stud cap 331D. In one embodiment of present invention, socket cap 331A and socket 331B sandwich a proximal section of lower strap 330 while stud 331C and stud cap 331D sandwich a distal portion of strap 330. These positions may be reversed. In use, stud 331C moves along its axis to snap into socket 331B, forming a pressure fit. Socket 331B includes, for example, a tight wire spring (not shown) that expands and contracts around stud 3310 as it is pressed on and pulled off.

The caps 331A and 331D shown in FIG. 27 are prong style, but post style caps may also be used. Similarly, and open prong ring may be used in place of stud cap 331D. An S, parallel, segmented or ring spring may be incorporated within socket 331B to form the pressure fit, as well as other pressure fit mechanisms.

Figure 28:
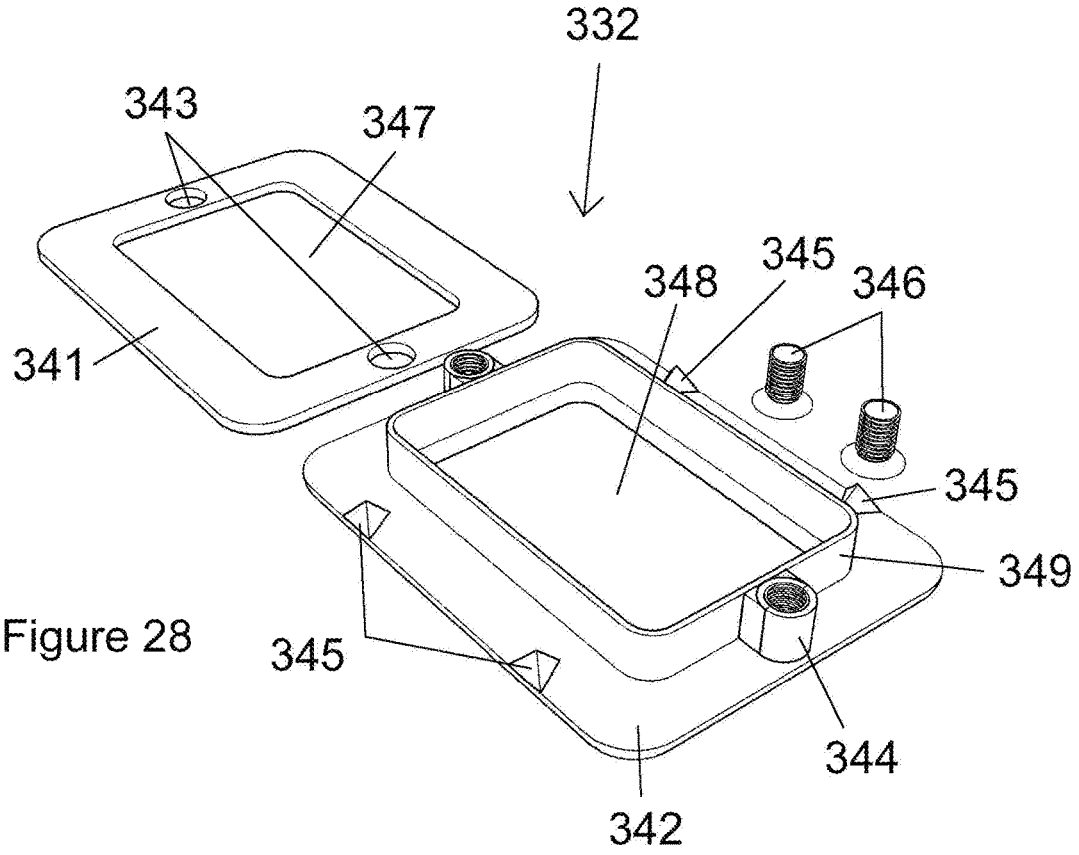
FIG. 28 is an exploded isometric view of the reinforced ring.

FIG. 28 is an exploded isometric view of reinforced ring or grommet 332. As noted, street sandals need to be tough. Reinforced grommet 332 is particularly well adapted for use with street sandals because it bolts into place and grips strap 334 all around opening 350. Grommet 332 is preferably formed of a tough metal such as brass or steel. It comprises a flat bolt side 341 and a thicker sleeve side 342. Bolt side 341 includes holes 343 for insertion of threaded bolts 346. Sleeve side 342 includes a flange 349 flanked by bolt threaded sleeves 344 into which threaded bolts 346 will be screwed. Sleeve side 342 further includes teeth or grippers 345 which dig into upper strap 334 and hold grommet 332 in place.

Figure 29:
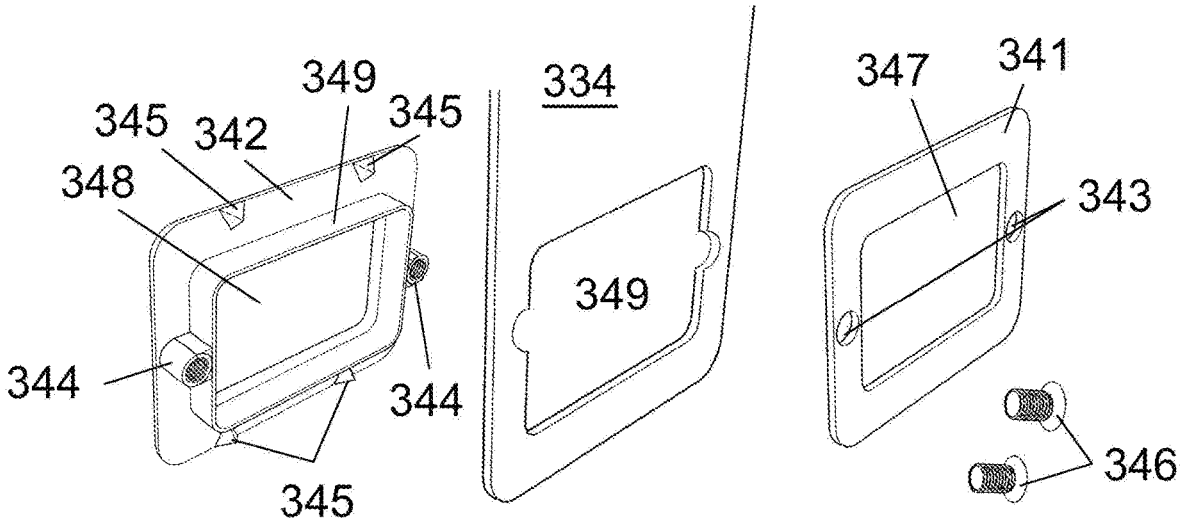
FIG. 29 is a side isometric view of the reinforced ring being installed on an upper snap.

FIG. 29 is a side isometric view of grommet 332 being installed on an upper strap 334. Flange 349 is inserted into opening 350 of strap 334. Bolts 346 pass through holes 343 and strap opening 350 and are screwed into sleeves 344. Grippers 345 press into the leather of strap 334.

In a preferred embodiment, the outer dimensions of grommet 332 are 16 mm×20 mm, while openings 347 and 348 are 10 mm×15 mm.

All patents and publications mentioned or incorporated into this specification are indicative of the levels of those skilled in the art to which the invention pertains. All patents and publications are herein incorporated by reference to the same extent as if each individual publication was specifically and individually indicated to be incorporated by reference.

It is to be understood that while certain forms of the invention are illustrated, it is not to be limited to the specific forms or arrangements herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well-adapted to carry out the objectives and obtain the ends and advantage mentioned, as well as those inherent therein. The embodiments, methods, procedures, and techniques described herein are presently representative of the preferred embodiments; are intended to be exemplary; and are not intended as limitations on the scope. Changes therein and other uses will occur to those skilled in the art which are encompassed within the spirit of the invention and are defined by the scope of the claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the claims.

What is claimed is:

1. An article of footwear comprising:

a sole having an upper surface, an opposed bottom surface, and a perimeter outside edge between said upper and bottom surfaces;

three selectively fastenable looping attachments, each of said looping attachments secured to said sole portion;

an upper constructed to enwrap a foot and secure the foot to said sole;

three reinforced generally rectangular grommets, each of said grommets embedded within said upper;

wherein each looping attachment includes a male portion of a compression snap on one end of the loop and a female portion of a compression snap on the other end of the loop and is configured to thread through one of the grommets and fasten a loop closed via the male portion of the snap snapping into the female portion of the snap, thereby retaining the grommet in the loop and attaching the sole to the upper; and wherein each reinforced grommet includes— threaded bolts, a grommet bolt side having bolt openings for the threaded bolts, and a grommet sleeve side having threaded sleeves extending from the grommet sleeve side, the threaded sleeves configured to engage with the threaded bolts, the grommet sleeve side further including a flange extending in the same direction as the threaded sleeves, wherein each reinforced grommet is installed in an associated upper opening formed in the upper by placing the grommet bolt side adjacent to the associated upper opening on one side of the upper, placing the grommet sleeve side adjacent to the associated upper opening on the other side of the upper with the flange and the threaded sleeves extending into the associated upper opening, and passing the bolts through the bolt openings and screwing the bolts into the threaded bolt sleeves.

2. The article of footwear of claim 1 wherein the upper includes three upper straps extending downward towards the sole and wherein the reinforced grommets are embedded within the upper straps.

3. The article of footwear of claim 2 wherein the upper straps are formed of leather.

4. The article of footwear of claim 3 wherein each reinforced grommet further includes teeth oriented to sink into the strap around its corresponding upper opening when the reinforced grommet is installed.

5. The article of footwear of claim 4 wherein the upper strap comprises leather.

6. The article of footwear of claim 4 wherein the reinforced grommet comprises metal.

7. An article of footwear comprising:

a sole having an upper surface, an opposed bottom surface, and a perimeter outside edge between said upper and bottom surfaces;

three lower straps attached to the sole perimeter, each lower strap forming a selectively fastenable looping attachment at its distal end;

an upper constructed to enwrap a foot and secure the foot to said sole; and three upper straps attached to the upper, each upper strap including a reinforced generally rectangular grommet embedded within said upper strap;

wherein each looping attachment includes a compression snap and is configured to thread through a reinforced grommet and fasten a loop closed via a male portion of the snap snapping into a female portion of the snap, thereby retaining the grommet in the loop and attaching the sole to the upper;

wherein the male portion of the compression snap includes a stud and the female portion of the compression snap includes a socket having a pressure fit mechanism for gripping the stud when the stud is inserted into the socket; and wherein each reinforced grommet includes— threaded bolts, a grommet bolt side having bolt openings for the threaded bolts, a grommet sleeve side having threaded sleeves configured to engage with the threaded bolts, and wherein each reinforced grommet is installed in an upper opening formed in the upper by placing the grommet bolt side adjacent to the upper opening on one side of the upper, placing the grommet sleeve side adjacent to the upper opening on the other side of the upper, and passing the bolts through the bolt openings and screwing the bolts into the threaded bolt sleeves.

8. The article of footwear of claim 7 wherein a first upper strap and a first lower strap are disposed between toes of a wearer, a second upper strap and a second lower strap are disposed on one side of an ankle of the wearer, and a third upper strap and a third lower strap are disposed on another side of the ankle of the wearer.

9. The article of footwear of claim 8 wherein the upper straps and the lower straps are formed of leather.

10. The article of footwear of claim 9 wherein the threaded sleeves extend outward from the grommet sleeve sides, wherein each grommet sleeve side further comprises a flange extending in the same direction as the threaded sleeve, and wherein the flanges and the threaded sleeves extend into the upper openings.

11. The article of footwear of claim 10 wherein the reinforced grommet further includes teeth oriented to sink into the upper strap around the opening when the reinforced grommet is installed.

12. The article of footwear of claim 1 wherein the reinforced grommet has outer dimensions on the order of 16 mm×20 mm.

13. The article of footwear of claim 7 wherein the reinforced grommet has outer dimensions on the order of 16 mm×20 mm.

14. The article of footwear of claim 1 wherein the reinforced grommet further includes teeth oriented to sink into the upper strap around the opening when the reinforced grommet is installed.

15. The article of footwear of claim 7 wherein the reinforced grommet further includes teeth oriented to sink into the upper strap around the opening when the reinforced grommet is installed.

* * * * *